US009616482B2

(12) United States Patent
Yang et al.

(10) Patent No.: US 9,616,482 B2
(45) Date of Patent: Apr. 11, 2017

(54) HOT FORMING METAL DIE WITH IMPROVED COOLING SYSTEM

(71) Applicant: Martinrea Industries, Inc., Troy, MI (US)

(72) Inventors: Di Yang, Troy, MI (US); Arpad Takacs, Thornhill (CA)

(73) Assignee: Martinrea Industries, Inc., Troy, MI (US)

( * ) Notice: Subject to any disclaimer, the term of this patent is extended or adjusted under 35 U.S.C. 154(b) by 162 days.

(21) Appl. No.: 14/532,627

(22) Filed: Nov. 4, 2014

(65) Prior Publication Data

US 2015/0121986 A1 May 7, 2015

Related U.S. Application Data

(60) Provisional application No. 61/900,003, filed on Nov. 5, 2013.

(51) Int. Cl.

| | |
|---|---|
| ***B21D 37/16*** | (2006.01) |
| ***B21D 22/02*** | (2006.01) |
| ***C21D 1/673*** | (2006.01) |
| *C21D 9/00* | (2006.01) |
| *B21J 1/06* | (2006.01) |

(52) U.S. Cl.

CPC ..... *B21D 37/16* (2013.01); *B21D 22/022* (2013.01); *C21D 1/673* (2013.01); *B21J 1/06* (2013.01); *C21D 9/0062* (2013.01); *C21D 2211/008* (2013.01)

(58) Field of Classification Search

CPC .... B21D 22/022; B21D 22/208; B21D 37/16; B21J 1/06; C21D 1/62; C21D 1/63; C21D 1/64; C21D 1/667; C21D 1/673; C21D 9/0062; C21D 9/46; C21D 9/48; C21D 2211/008; B22C 9/065; F28F 7/02; F28F 13/003

USPC ..... 72/342.1–342.94, 364, 463, 469, 470

See application file for complete search history.

(56) References Cited

U.S. PATENT DOCUMENTS

| | | | | |
|---|---|---|---|---|
| 4,126,492 | A * | 11/1978 | Okunishi | B21D 53/34 148/534 |
| 5,603,871 | A * | 2/1997 | Koseko | B29C 33/04 264/1.9 |
| 6,354,361 | B1 | 3/2002 | Sachs et al. | |
| 7,124,810 | B2 * | 10/2006 | Lee | F28D 15/046 165/104.21 |
| 8,555,691 | B2 | 10/2013 | Kurisu et al. | |
| 2002/0113041 | A1 | 8/2002 | Ozawa | |
| 2005/0263673 | A1 | 12/2005 | Bachan | |
| 2007/0102837 | A1 * | 5/2007 | Manuel | B23P 15/24 264/35 |
| 2009/0320547 | A1 * | 12/2009 | Horton | B21J 13/02 72/342.3 |
| 2013/0040012 | A1 * | 2/2013 | Sugie | B29C 33/02 425/404 |

(Continued)

*Primary Examiner* — Peter DungBa Vo
*Assistant Examiner* — Joshua D Anderson
(74) *Attorney, Agent, or Firm* — Dinsmore & Shohl LLP

(57) ABSTRACT

A hot metal forming apparatus having a pair of dies which are movable between an open and closed position relative to each other. The dies have facing metal forming surfaces corresponding to the shape of the desired stamped part. At least one elongated heat pipe is mounted within at least one die for transferring heat away from the stamped part thus quenching the stamped part.

10 Claims, 4 Drawing Sheets

(56) References Cited

U.S. PATENT DOCUMENTS

| | | | | |
|---|---|---|---|---|
| 2013/0239410 | A1* | 9/2013 | Chung | F28D 15/02 29/890.032 |
| 2013/0323348 | A1* | 12/2013 | Chung | B29C 45/7331 425/547 |
| 2015/0165665 | A1* | 6/2015 | Guichard | H05B 6/42 425/552 |
| 2015/0266220 | A1* | 9/2015 | Fideu | B29C 33/02 264/328.16 |

* cited by examiner

HOT FORMING METAL DIE WITH IMPROVED COOLING SYSTEM

CROSS-REFERENCE TO RELATED APPLICATIONS

This application claims priority of U.S. Provisional Application No. 61/900,003 filed Nov. 5, 2013, the contents of which are incorporated herein by reference.

BACKGROUND OF THE INVENTION

I. Field of the Invention

The present invention relates generally to hot metal forming apparatuses.

II. Description of Related Art

There are many industrial applications in which a very hard component is required. For example, in automotive vehicles some components, such as the vertical pillars for the automotive vehicle passenger compartment, are typically constructed of high strength, lightweight materials to protect the occupants of the vehicle in the event of a crash and yet not unduly increase the weight of the vehicle.

One common hard material used in automotive applications is martensite, an allotrope of carbon steel. In order to form a martensite component, a sheet stock or blank of carbon-based with boron element steel is first heated to approximately 850-1100° centigrade which is the temperature necessary to transform the metal blank to austenite. Then, while the metal blank is still hot and above a temperature of about 450° centigrade, the metal blank is positioned within a stamping die and the die is closed to mechanically bend and shape the blank to the shape of the desired component which is defined by the facing surfaces of the die. The now formed component is then quenched at a rapid rate sufficient to transform the austenite to martensite. After quenching, the component is removed and allowed to finish cooling in the air to let the chemical change to martensite finish.

While components formed using the hot stamping method exhibit sufficient hardness, the hot stamping method is expensive to perform in a production facility. A great deal of this cost results from the time needed to quench the now formed blank in the die to a sufficiently low temperature to convert or transform the austenite to martensite. Indeed, in the previously known hot forming metal dies, the overall cycle time for quenching the formed parts can require 10 seconds or even more time in a production facility based on the specific profile of the stamped part. Such a long cycle time in some cases requires the use of multiple stamping dies in order to meet production needs.

SUMMARY OF THE PRESENT INVENTION

The present invention provides an apparatus for hot metal forming or hot metal stamping with improved cooling means to quench the formed part following the stamping operation.

In brief, the apparatus of the present invention includes a housing having a bed dimensioned to support a blank for the hot stamping operation. The bed is constructed of a thermally conductive material, such as metal, and has a surface machined to support the entire blank.

The upper plate or upper die is mounted to the upper "shoe" (top plate). The lower plate or lower die is mounted to the lower shoe. The upper and lower "shoes" (plate assemblies) are guided in a horizontal direction by guide pins. The upper and lower "shoes" (mounting plates) move in an up and down vertical motion in either a hydraulic or mechanical punch press. When the upper shoe is in the open position making a gap between upper and lower mounting plates the heated "blank" material is introduced/placed onto the lower tool. The blank is positioned using a form of either pneumatic/hydraulic or mechanical locators and levelers. Locators are to position the blank steel and levelers are used to hold the blanks in a horizontal position using small fingers so that the blanks do not make contact with any die surfaces that would start cooling the blanks in individual areas which could affect the outcome of the overall hardness. The blank levelers hold the blanks in position along with the locators as the upper die closes with the press onto the lower die and the press then remains closed while cooling takes place.

At least one, and preferably a plurality of elongated heat pipes are attached to both the upper as well as the lower die. One end of each heat pipe is embedded within the interior of the die, while its opposite end is positioned outside of the die.

Each heat pipe includes a tubular and preferably cylindrical sintered powder wick surrounded by a heat conductive casing. Both ends of the heat pipe are also sealed by the casing while a fluid, such as water, is entrapped within the interior of the heat pipe.

One end of the heat pipe is embedded within either the upper or the lower die while the other end of the heat pipe is thermally coupled to a cooling mechanism. For example, the second end of the heat pipe may be positioned within a cooling fluid bath, a heat sink, cooling bath or channel that allows for a constant water flow through the tooling in order to be able to maintain a constant water temperature at the heat pipe ends in order to remove heat from the heat pipe.

In operation, the fluid contained within the heat pipe boils at the hot end of the heat pipe and the now vapor liquid enters into the interior of the sintered powder wick. This vapor flows towards the other end of the heat pipe where the cooling mechanism cools the vapor back into a liquid. That liquid travels by capillary action through the sintered powder wick back to the hot end of the heat pipe where it is again transformed into a vapor and the cycle is then repeated.

Consequently, by providing at least one, and preferably a plurality of heat pipes for both the upper and the lower die, the dies, and thus the stamped part, may be rapidly quenched by the heat pipes. In operation, a quenching cycle time of approximately 1 second may be achieved through the proper use of heat pipes in both the upper and lower dies.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
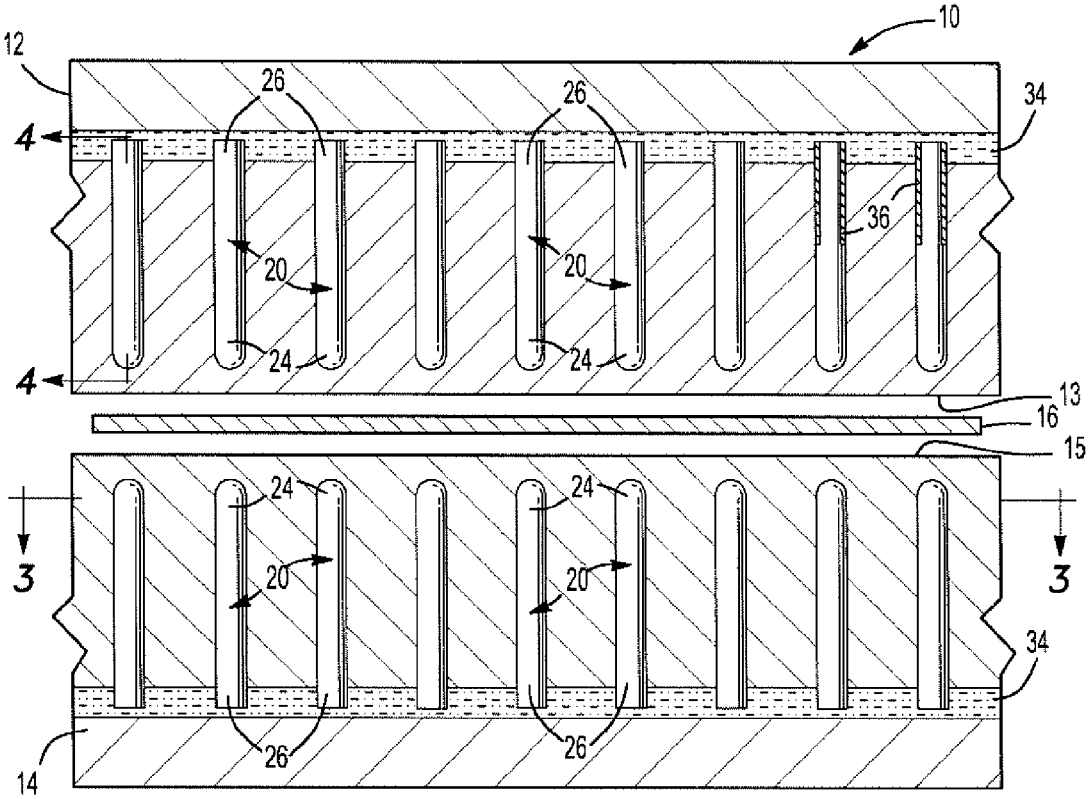
FIG. 1 is a diagrammatic side view illustrating an upper and lower hot stamping die in their spaced apart position.
Figure 2:
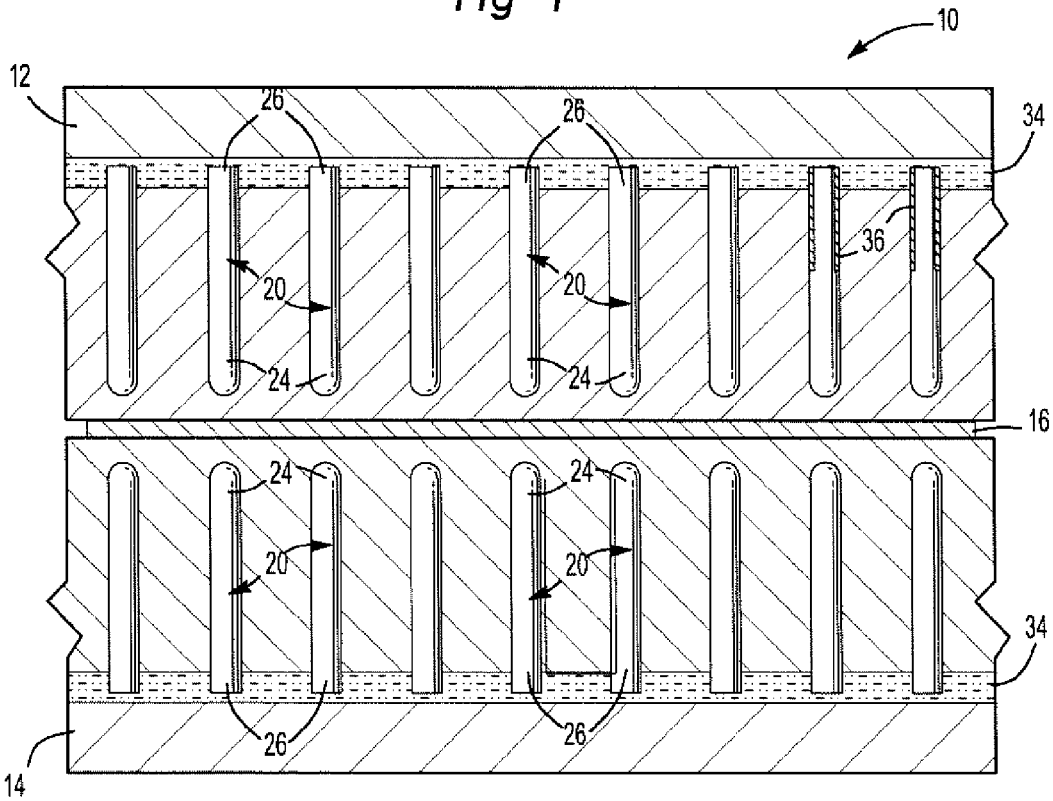
FIG. 2 is a view similar to FIG. 1, but illustrating the upper and lower dies in their closed position during a stamping operation.

With reference first to FIGS. 1 and 2, a preferred embodiment of a hot stamping press 10 is shown. The press 10 includes both a lower die 14 mounted in a lower shoe and an upper die 12 mounted in an upper shoe, both of which are constructed of a thermally conductive material, such as metal. The upper die 12 and lower die 14 have facing metal forming surfaces 13 and 15, respectively, machined to correspond to the shape of the desired stamped metal part.

The upper die 12 is positioned above the lower die 14 and movable between an open position, illustrated in FIG. 1, and a lower position, illustrated in FIG. 2. In its upper position, the upper die 12 is spaced from the lower die 14 to enable a metal blank 16 to be inserted in between the dies 12 and 14. This metal blank 16 is typically constructed of a carbon-based material typically with boron which is heated to approximately 850-1100° centigrade. A carbon-based material transforms to austenite in the temperature range of 850-1100° centigrade.

Any conventional mechanism may be used to heat the metal blank 16 to 850-1100° centigrade. Furthermore, the blank 16 may be heated to 850-1100° centigrade prior to insertion in between the upper die 12 and lower die 14, or after insertion between the upper and lower dies 12 and 14.

After the metal blank 16 has been inserted in between the upper die 12 and lower die 14, the upper die 12 and lower die 14 are moved to their closed position illustrated in FIG. 2. In their closed position, the metal blank 16 is sandwiched in between the metal forming surfaces 13 and 15 on the upper die 12 and lower die 14, respectively, so that the blank 16 takes on the shape of the facing surfaces 15 and 13 of the upper die 12 PM and lower die 14.

Any conventional means may be utilized to move the upper and lower dies 12 and 14 between their open position, illustrated in FIG. 1, and their closed or stamping position, illustrated in FIG. 2. For example, a hydraulic or pneumatic cylinder may be used to move one or both of the dies 12 and 14 toward and away from each other. Alternatively, a mechanical drive or even electric drive may be used to move the dies 12 and 14.

In order to transform the now formed metal blank 16 from austenite to martensite, the stamped part 16 formed by closure of the dies 12 and 14 must be rapidly quenched to a temperature of below about 250° centigrade, depending upon the material of the blank 16.

Figure 4:
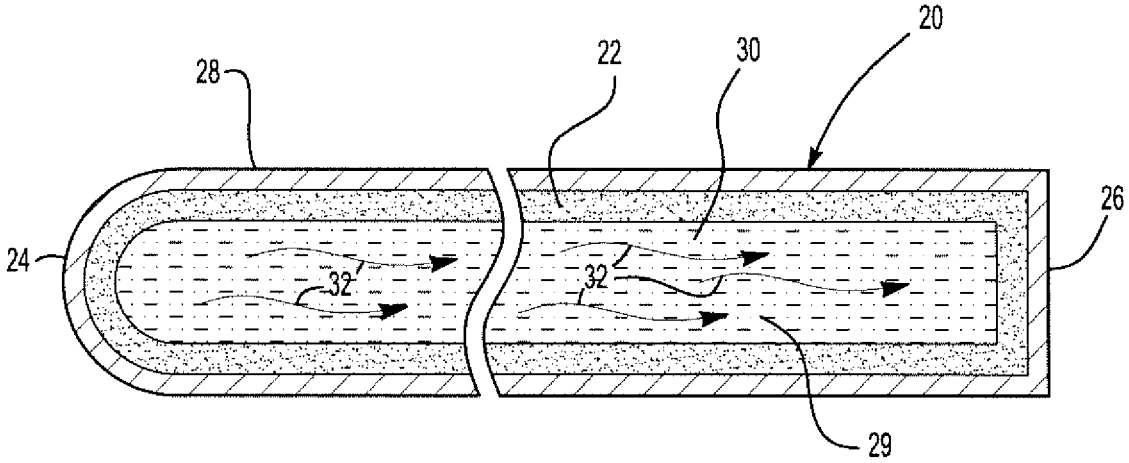
FIG. 4 is a longitudinal sectional view taken substantially along line 4-4 in FIG. 1 and enlarged for clarity.
Figure 5:
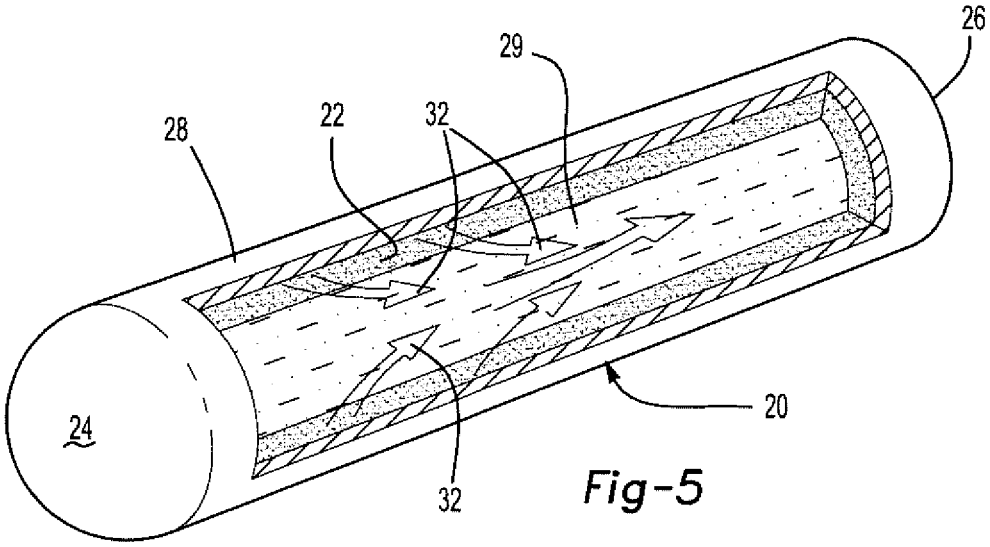
FIG. 5 is an elevational view of a heat pipe with parts removed for clarity.

With reference now to FIGS. 4 and 5, in order to quench the stamped part 16, the present invention utilizes a plurality of heat pipes 20, one of which is shown in both FIGS. 4 and 5. Each heat pipe includes a tubular and cylindrical sintered powder wick 22 which is closed at both a heated end 24 and a cooled end 26. The wick 22 may be constructed of many types of different materials, such as a sintered copper or sintered copper/nickel material. Since the wick 22 is constructed from the sintered material, the wick 22 remains porous throughout its length between the ends 24 and 26.

The entire wick 22 is encased in a fluid-impermeable casing 28 which forms a closed chamber 29. The casing 28 may be made of copper, a copper/nickel alloy, or any other materials provided, however, that the casing 28 exhibits high thermal conductivity.

Still referring to FIGS. 4 and 5, a liquid, such as water, partially fills the interior chamber 29 of the casing 28 and thus entrapped within the wick 22 and an interior bore 30 of the wick 22. Other liquids, however, may alternatively be used. Furthermore, the liquid fills only a small fraction of the volume of the chamber 29.

As will subsequently be described in greater detail, the heated end 24 of the heat pipe 20 is positioned adjacent the heated stamped part while the cooled end 26 of the heat pipe 20 is positioned in a coolant, such as a water bath or water channel, cool air, etc. In operation, the liquid contained within the interior chamber 29 of the casing 28 becomes heated and boils or vaporizes at the heated end of the heat pipe. The vapor then travels towards the cool end 26 of the heated pipe which is positioned within the coolant. At the cool end of the heat pipe 20, heat is transferred from the heat pipe 20 to the coolant and the vapor condenses into a liquid and enters into the wick. Through capillary action, the liquid travels from the cool end 26 of the heat pipe 20 through the wick and towards the heated end 24 of the heat pipe 22. Once the liquid reaches the heated end 24 of the heat pipe 20, the liquid is again vaporized or boiled and flows as indicated by arrows 34 in FIG. 4 and the above process is repeated.

Figure 9:
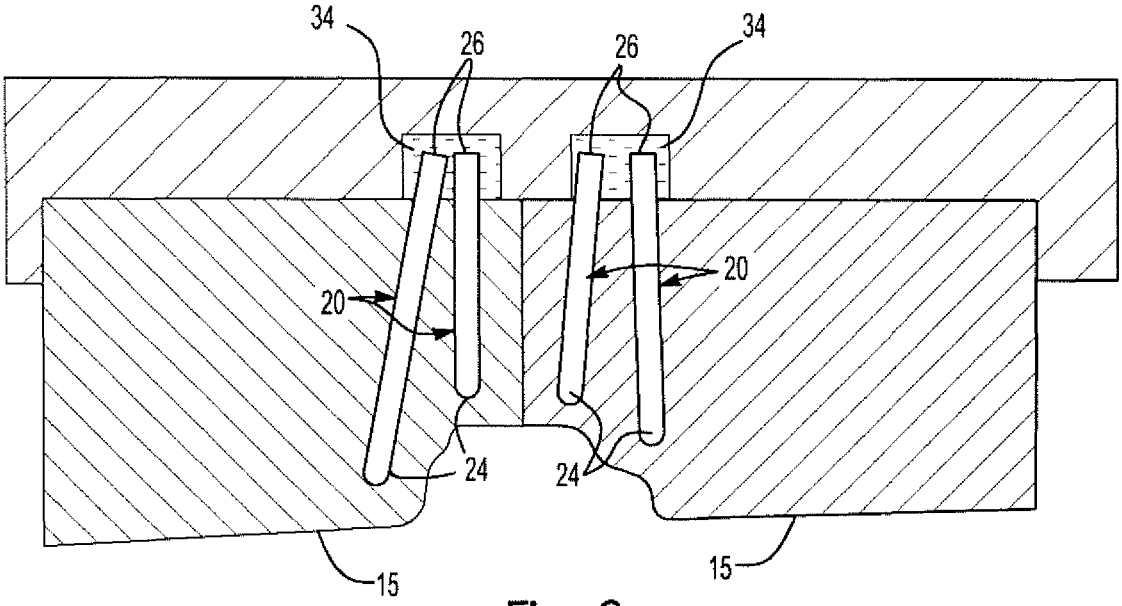
FIG. 9 is a fragmentary sectional view illustrating a portion of a die of the apparatus of the present invention.

Consequently, the heat pipe 20 serves to remove heat from its heated end 24 and to dissipate the heat at its cooled end 26. As shown in FIG. 9, in order to further enhance and facilitate the heat removal characteristics of the heat pipe 20, the cooled end 26 of the heat pipe 20 is preferably cooled either in a cooling bath or channel 34, a heat sink, a radiator, or other conventional heat removal devices.

Figure 3:
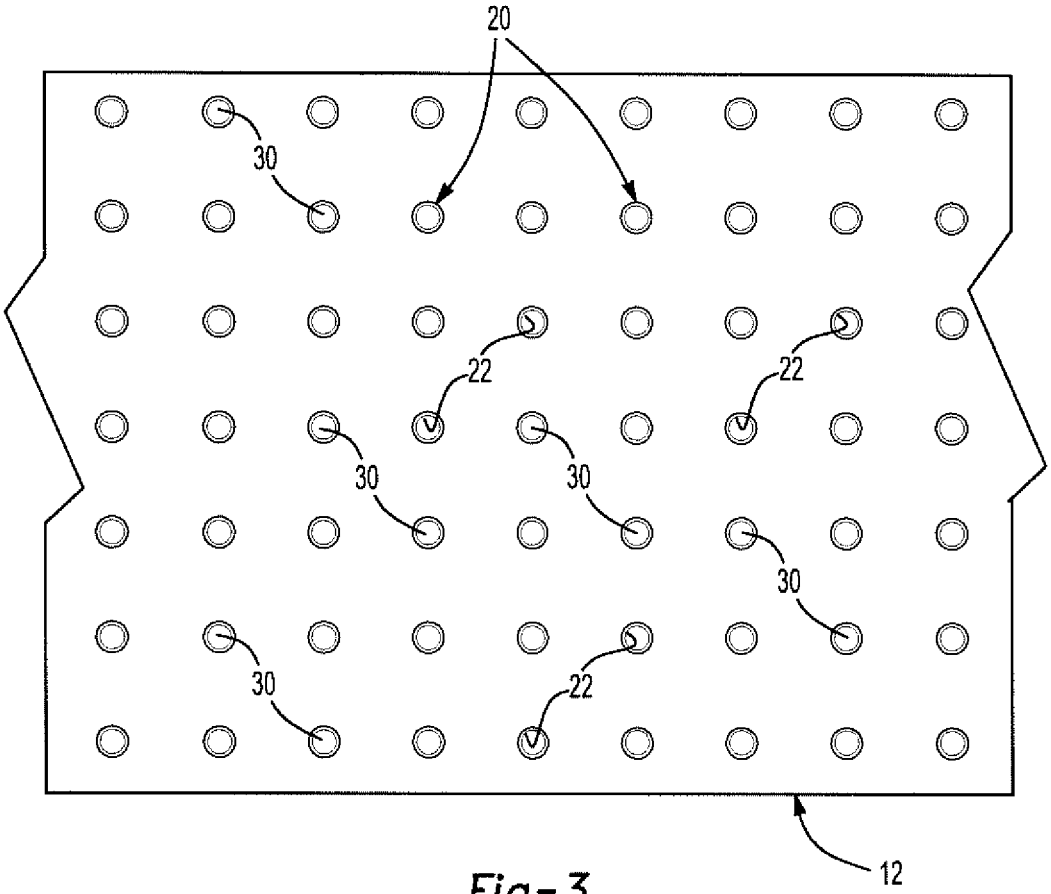
FIG. 3 is a view taken substantially along line 3-3 in FIG. 1.

With reference now to FIGS. 1 and 3, a plurality of heat pipes 20 are positioned within at least one, and preferably, both the upper die 12 and the lower die 14. The heated end 24 of each heat pipe 20 is positioned adjacent the facing surfaces of the upper die 12 and lower die 14 and thus near the blank 16. Conversely, the cooled end 26 of each heat pipe 20 extends outwardly from its associated die 12 or 14. This cooled end 26, furthermore, is preferably positioned within a cooling bath 34 or other mechanism to remove heat from the ends 26 of the heat pipes 20.

As perhaps best shown in FIG. 9, the heated ends 24 of the heat pipes 20 are positioned closely adjacent the working surface 13 or 15 of either the lower die or upper die, respectively. For example, the heated ends 24 of the heat pipes 20 are preferably positioned ½ inch or less away from the metal forming surface 15 of the die 14. Conversely, the cool ends 26 of the heat pipes 20 are spaced away from the metal forming surface 15 of the die 14 and are preferably positioned within a coolant bath or coolant channel 34. The channel 34 may be cooled by any suitable liquid, such as water.

In order to maximize the heat transfer by the heat pipes 20, the portions of the heat pipes 20 adjacent their heated ends 24 are snugly positioned within their receiving openings in the die 14. A snug fit between the heat pipes 20 adjacent their heated ends 24 and the die 14 ensures an efficient thermal conductivity between the die 14 and the heat pipes 20. A thermally conductive material, such as grease or epoxy, may also be used between the heated ends 24 of the heat pipes 20 to maximize the heat conductivity from the die 14 and to the heat pipes 20.

The length, diameter, and number of heat pipes 20 will vary depending upon the application. However, in an application in which the pillar for the passenger compartment of an automotive vehicle is stamped from the blank, the heat pipes 20 may range between 2 and 10 inches long and approximately ½ inch in diameter. The heat pipes 20 may be spaced apart from each other between ½ and 2 inches in any suitable pattern, such as the pattern illustrated in FIG. 3.

In operation, as the dies 12 and 14 are moved between their open position, illustrated in FIG. 1, and their closed position, illustrated in FIG. 2, heat is transferred from the blank 16 to the dies 12 and 14. That heat, in turn, is removed by the heat pipes 20 thus effectively quenching the now formed blank 16 and transforming the austenite material to martensite.

Referring now particularly to FIG. 2, in order to enhance the transfer of heat from the heated end 24 of the heat pipes 20, insulation 36 is optionally provided around a mid portion of each heat pipe 20. This insulation effectively ensures that the heat is transferred from the heated end 24 and to the cool end 26 of each heat pipe 20 while minimizing heating of the dies 12 and 14 from heat conduction along a central portion of the heat pipes 20.

Figure 6:
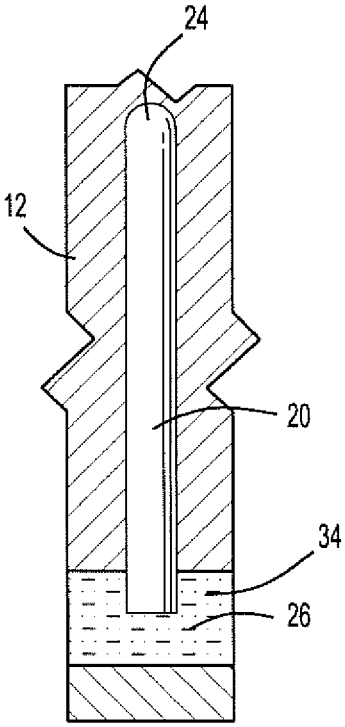
FIG. 6 is a plan view of one heat pipe mounted in a vertical position in a die.

With reference now to FIGS. 1, 3, and 6, the heat pipes 20 are shown mounted in the dies 12 and 14 in a generally vertical orientation and with the heat pipes spread out both horizontally and vertically from each other as shown in FIG. 3. The distribution of the heat pipes in the upper die 12, furthermore, is substantially the same as the lower die 14 as shown in FIG. 3.

Figure 7:
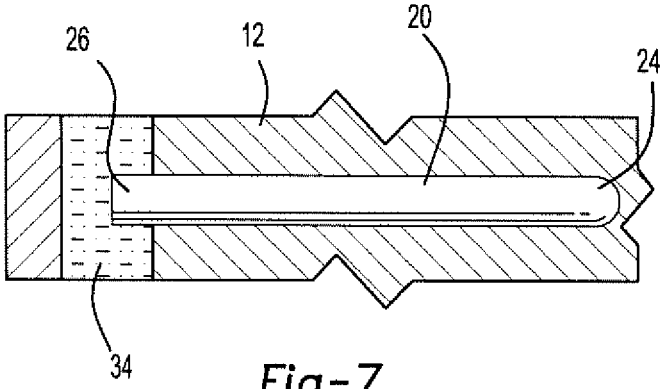
FIG. 7 is a plan view illustrating one heat pipe mounted in a horizontal position in a die.
Figure 8:
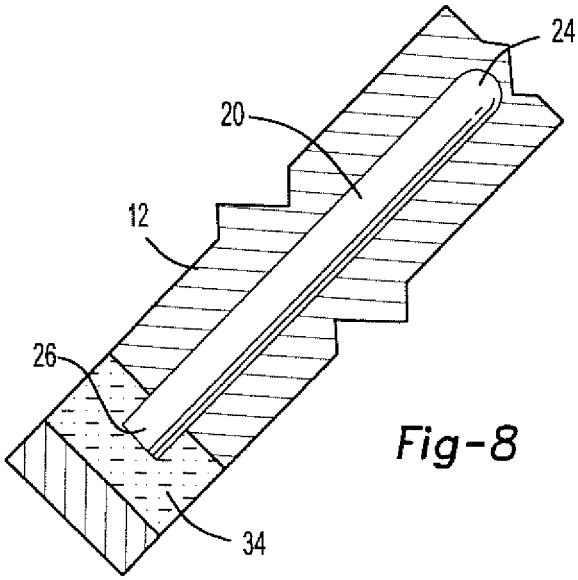
FIG. 8 is a view of one heat pipe mounted at an acute angle in a die.

Although the heat pipes 20 are illustrated in a substantially vertical, but preferably slightly angled, orientation in FIGS. 1 and 2, other orientations of the heat pipe may be used without deviation from the spirit or scope of the invention. For example, the heat pipes 20 may be substantially horizontally oriented as shown in FIG. 7. Likewise, the heat pipes 20 may be tilted from the horizontal as shown in FIG. 8.

In practice, it has been found that, by using numerous heat pipes as illustrated in FIG. 3, the cycle time necessary to quench the parts formed by the hot stamping process may be reduced to approximately 1 second.

From the foregoing, it can be seen that the stamping apparatus of the present invention provides a novel stamping operation for hot metal forming which enjoys a very short cycle time. Having described the invention, however, many modifications thereto will become apparent to those skilled in the art to which it pertains without deviation from the spirit of the invention as defined by the scope of the appended claims.

We claim:

1. Hot metal forming apparatus comprising:

a pair of dies, at least one of said dies movable relative to the other die between an open and a closed position, said dies dimensioned to receive a heated metal sheet therebetween when said open position, said dies having facing metal forming surfaces, configured to stamp the heated metal sheet received between the dies into a shape of the facing metal forming surfaces when the dies are in the closed position, a plurality of elongated heat pipes mounted in at least one die of the pair of dies, each said heat pipe having a first end positioned adjacent one of said metal forming surfaces and a second end spaced from said metal forming surfaces, each said heat pipe having a casing which forms a closed interior chamber extending from the first end to the second end that is fluidly separated from the closed interior chambers of the other heat pipes, and a liquid which partially fills each said chamber, wherein each heat pipe is configured to transfer heat from the metal forming surfaces to transfer heat from the stamped metal sheet.

2. The apparatus as defined in claim 1 wherein said second end of said heat pipe is positioned in a coolant.

3. The apparatus as defined in claim 2 wherein said coolant comprises a water bath.

4. The apparatus as defined in claim 2 wherein said coolant comprises air.

5. The apparatus as defined in claim 1 wherein said liquid comprises water.

6. The apparatus as defined in claim 1 wherein each said heat pipe includes a wick attached to an inner surface of said casing.

7. The apparatus as defined in claim 6 wherein said wick comprises a sintered metal.

8. The apparatus as defined in claim 7 wherein said sintered metal comprises copper.

9. The apparatus as defined in claim 8 wherein said sintered metal comprises nickel.

10. The apparatus as defined in claim 1 and comprising a plurality of heat pipes mounted to both dies.

* * * * *